United States Patent [19]

Ovadia et al.

[11] 4,432,456

[45] Feb. 21, 1984

[54] JEWELRY DISPLAY AND STORAGE APPARATUS

[76] Inventors: Joseph Ovadia; Abraham Ovadia, both of 150 W. 47th St., New York, N.Y. 10036

[21] Appl. No.: 336,819

[22] Filed: Jan. 4, 1982

[51] Int. Cl.[3] ..... B65D 1/36; B65D 6/04

[52] U.S. Cl. ..... 206/566; 206/45.19; 206/509; 206/499

[58] Field of Search ..... 206/566, 45.14, 45.19, 206/477, 480, 483, 499, 486, 489, 509, 511; 220/23.6

[56] References Cited

U.S. PATENT DOCUMENTS

| | | | |
|---|---|---|---|
| 3,416,655 | 12/1968 | Shiffman | 206/566 |
| 3,777,882 | 12/1973 | McIntyre | 206/499 |
| 4,099,611 | 7/1978 | Feibelman | 206/45.14 |
| 4,181,224 | 1/1980 | Aber | 206/566 |
| 4,332,320 | 6/1982 | Feibelman | 206/45.14 |
| 4,349,109 | 9/1982 | Scordato et al. | 206/499 |

*Primary Examiner*—William T. Dixson, Jr.
*Assistant Examiner*—Brenda J. Ehrhardt
*Attorney, Agent, or Firm*—Wolder, Gross & Yavner

[57] ABSTRACT

A jewelry display and storage device including a stackable open grid frame and a plurality of domed jewelry display pads. The walls of the frame and the display pads cooperate to form a mechanism wherein the pads are removably retained within the frame. Mounting means are located on the display pads for securing jewelry items thereto. The mounting means are offset so that a 180 degree rotation of a pad or frame clearance is established between jewelry items on adjacent frame levels when stacked. The jewelry items on a given frame level sit within the next grid level below the bottom of the next display pad. With this configuration economies of space are achieved.

10 Claims, 6 Drawing Figures

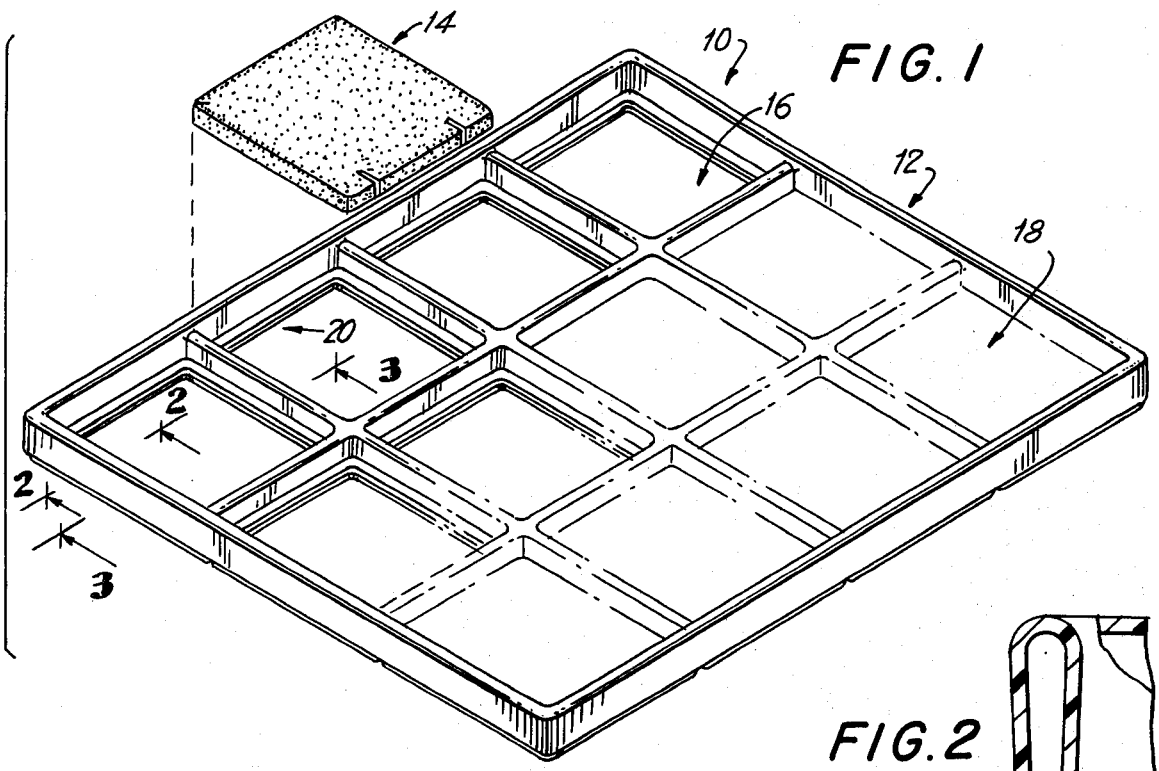
FIG. 1
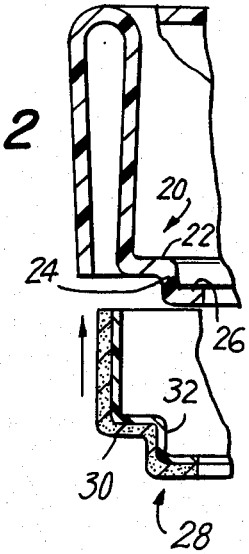
FIG. 2
FIG. 3
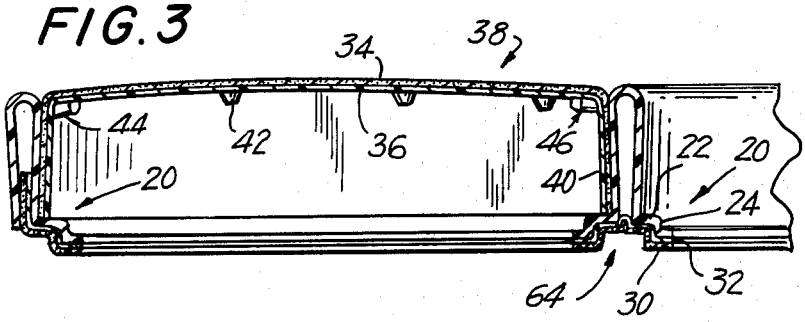
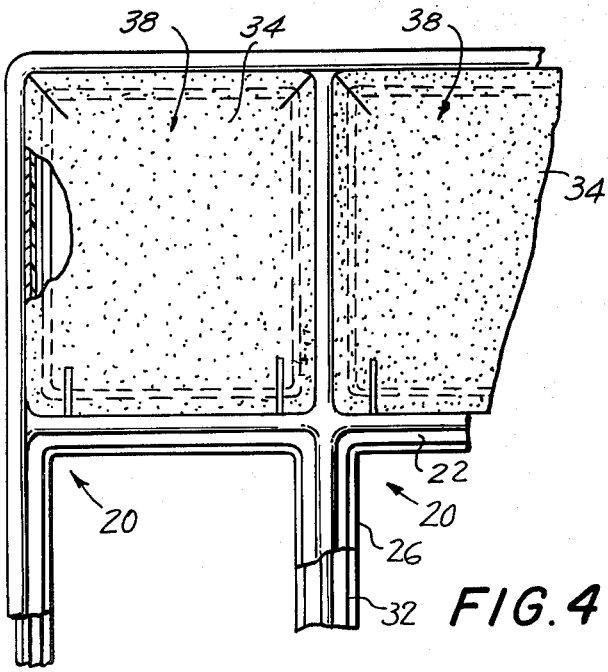
FIG. 4
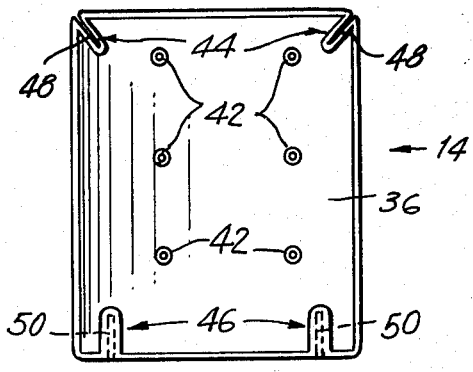
FIG. 5

JEWELRY DISPLAY AND STORAGE APPARATUS

The present invention relates generally to devices for storing and displaying items of jewelry, and more particularly to such a storage and display device which can be used in the typical fashion for display purposes and which can be compactly nested with similar devices for easy storage.

While jewelry items such as earring, pendants and chains can be stored and displayed in a variety of trays, holders or racks, the common type of storage device is a cushioned pad through which the earrings or pendant post can be inserted and through which mounting pins can be placed to hold a chain. These pads are normally provided with a peripheral pull tab, and are mounted in a framework or box divided into a series of closed-bottom chambers. The peripheral pull tab allows the pad to be removed from the framework for closer inspection by the vendor or potential purchaser.

In order to effect a degree of storage economy, such a framework is often designed to stack upon a similar frame. This is often done by the use of spacer elements or a peripheral downward extending lip. Because the pads are of substantial thickness and are placed in a closed-bottom framework, however, the spacer elements must be of a size that prevents contact between the displayed jewelry and the bottom of the next-stacked frame.

This requirement for additional height limits the number of tray frames which may be stacked in a given volume. Further, the use of the peripheral pull tab on the jewelry mounting pad often makes it difficult to remove the pad from the framework as often as insufficient amount of the tab projects upwardly above the frame. Further, the use of such tabs produces a somewhat untidy appearance. Still further the individual pads normally sit within the tray without any means for insuring that they remain affixed therein.

It is therefore an objective of the present invention to provide a jewelry display apparatus which makes efficient use of available volume.

Another object of the present invention is to provide a jewelry display apparatus in which individual jewelry mounting pads may be easily removable from the frame.

Yet a further object of the present invention is to provide a jewelry display apparatus which does not utilize pull tabs in conjunction with the individual display pads.

A still further object of the present invention is to provide a stackable display apparatus in which the individual display pads are effectively retained within the framework but may be easily removed as desired.

The foregoing features and advantages are generally accomplished by providing a jewelry display apparatus in the form of an open grid frame having generally upstanding walls. Within a grid chamber defined by the walls is located an individual jewelry display pad. Each of the jewelry display pads includes a top surface upon which the jewelry item may be displayed and a bottom surface, which bottom surface along with the chamber walls define an open bottom chamber. The framework is so dimensioned and constructed as to be stackable upon an identical framework such that the jewelry displayed on the individual pads of the first apparatus sits within the chamber defined by the bottom surface of the corresponding pad and chamber walls of the next succeeding apparatus frame. The individual pad elements may be permanently affixed within the grid or may be removable. If desired to be removable the grid walls and sides of the pads have cooperating tapers such that a snap fit of the pad into the chamber is effected. Removal of the pad is easily accomplished by pushing upwards on the bottom surface of the pad through the open bottom of the gridwork.

Each pad is provided with one or more jewelry mounting means. Each mounting means is located on the pad such that a 180 degree reversal of either the pad within the frame, or the frame itself with respect to the frame upon which it is stacked creates an offset between the positioning of the jewelry items mounted thereon. This offset permits the close packing of the stacked frames without interference or contact between jewelry items occupying the same pad location on sequential frames.

Other objects, features and advantages of the present invention will become apparent from the following detailed description of a preferred but nonetheless illustrative embodiment of the present invention when taken in connection with the appended drawings, wherein:

FIG. 1 is a perspective view of the frame of the present invention showing a typical jewelry display pad oriented for insertion into a grid chamber;

FIG. 2 is an elevation section view taken along line 2—2 of FIG. 1 detailing the frame construction;

FIG. 3 is an elevation section view taken along line 3—3 of FIG. 1 and including an individual jewelry display pad in position detailing the retention of the pad within the framework;

FIG. 4 is a top plan view of a section of the apparatus showing the individual jewelry display pads in position;

FIG. 5 is a bottom plan view of a typical individual jewelry display pad illustrating the jewelry mounting means thereon;

Figure 6:
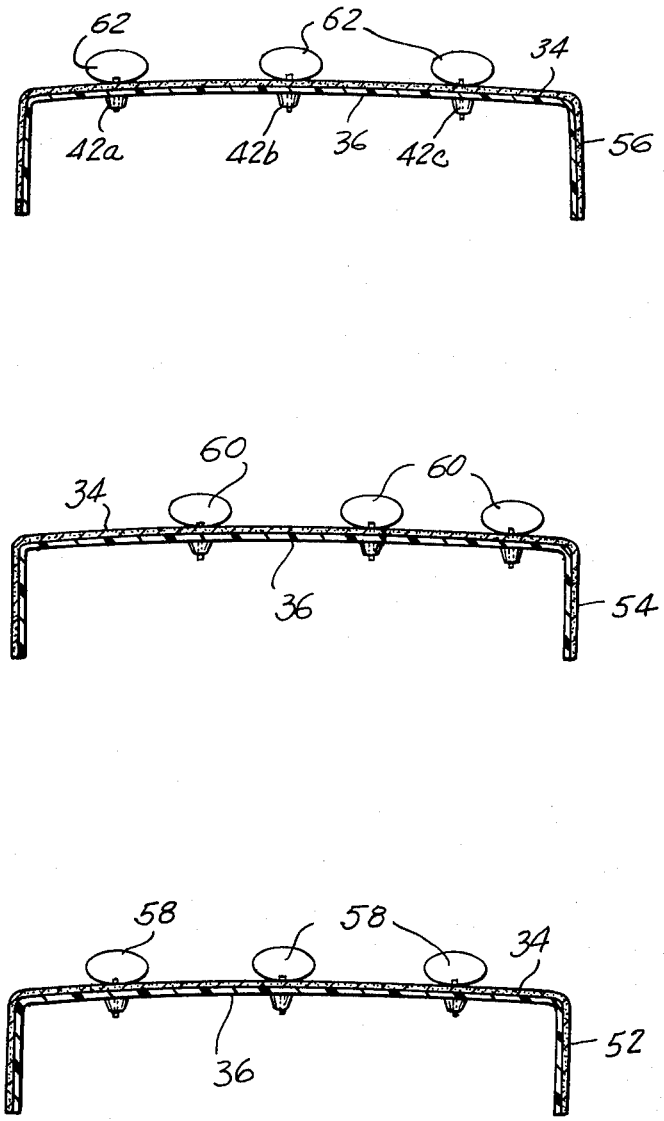
FIG. 6 is a diagrammatical view of the three pads as if positioned in three stacked frames showing the offset between jewelry items in adjacent levels.

Referring initially to FIG. 1, the jewelry display apparatus 10 of the present invention comprises grid forming framework 12 and one or more individual jewelry display elements 14. Framework 12 consists of a series of interconnecting walls 16 which define a series of apertures 18 in which the individual jewelry display pad elements are mounted. As shown in the figures, framework 12 may define a series of rectangular apertures 18 or any other appropriate shape consistent with the shape of the individual jewelry display pad elements to be inserted therein.

Referring now to FIG. 2, framework 12 may be economically and conveniently stamped or molded from a single piece of plastic or similar material. When so formed, walls 16 may be hollow, and somewhat wider at their top than at their bottoms. This configuration defines an inwardly directed taper over the height of the wall such that the cross sectional area of the apertures 18 defined by the walls 16 is somewhat less at the top of the wall than at the bottom. This taper, in conjunction with the shape of the jewelry display pad elements 14, as to be discussed infra, creates a simple yet effective retention system for the pad elements.

Walls 16 terminate at their bottom in step 20, which both provides a stop for the inserted jewelry display pads 14 and a base upon which the frame sits. Step 20 includes first horizontal section 22 forming the stop, vertical section 24, and base section 26. FIG. 2 illustrates this structure with respect to an outer wall, while FIG. 3 illustrates the structure with respect to an inner wall. It is to be noted that, as applied to an inner wall section, vertical sections 24 defines grooves between them which lie in the same vertical plane on the top of the wall section from which it is formed. This forms the basis for the stackability feature of the apparatus.

When formed as shown in the figure, the bottom of framework 12 may be covered by flocking to provide a finished appearance and to provide a smooth, non-scratch surface. This flocking can be advantageously applied by means of insert layer 28, which comprises a layer of flocking 30 bound to a thin backing piece 32, which may be of plastic or comparable material. The insert layer is bound to the bottom of the framework, such as by gluing, and due to the flexibility of the backing piece 32 follows the topography of the bottom. The insert layer is further cut to so that the apertures 18 remain open.

Referring to FIGS. 3 and 5, jewelry display pad elements 14 are rectangular in plan, and are dimensioned to fit within the apertures 18 defined by framework 12. Display pads 14 include an outer flocked layer 34 to provide a rich looking and non-scratch surface for the mounting of the jewelry, and an inner layer 36 of plastic, such as styrene. The pad elements include a display top 38 which may be slightly dome shaped, as well as depending peripheral lip 40 as may be best seen in FIG. 3. Depending lip 40 is slightly flared outwardly towards its bottom edge such that it may be easily retained by the flared walls 16. The inherent flexibility of the plastic layer 36 permits the pad element to deform slightly as required upon insertion into and removal from aperture 18.

As may be seen in FIG. 5, display pad 14 may include one or more sets of jewelry-retaining members molded therein. For example, earring support mounts 42, which are in the form of hemispheric projections blow molded into the plastic layer, may be located on the bottom surface of display surface 38. These hemispheric projections, due to the inherent flexibility of the plastic material, tend to grip earring posts inserted therethrough and therefore provide retention means for the earrings without the necessity of using the earring backing posts. Similarly, blow molded chain depressions 44 and 46, having slots 48 and 50 respectively therein, provide a convenient means for supporting necklace chains. Again, the inherent flexibility of the plastic layer allows the chain to be gripped without damage. Further, the individual fiber elements of flocking layer 34 tend to overlay the slots, and further conceal the slots from view, thus providing a more esthetically pleasing pad appearance. The display pad may be further provided with a pocket (not shown) in the bottom surface of the display top 38 to store the length of chain not displayed.

Earring support mounts 42 are arranged in pairs to display earring sets. As shown in the figures, three pairs of mounts may be formed on one pad to permit the simultaneous display of more than one earring set on a pad. The support mounts 42 are so arranged on pad 14 as to be asymmetrical about the horizontal center line of the pad, as shown in FIG. 5. The offset further permits efficient use of space, as a 180 degree rotation of alternate frame layers when in the stacked configuration offsets the corresponding mounts on the layers. Earrings mounted thereon thus do not lie in the same vertical plane as those on the frames directly above or below them, thus effectively utilizing the otherwise lost volume between the individual earring elements on a given pad.

This configuration is illustrated in FIG. 6, where three pad levels are shown. Both upper pad 56 and lower pad 52 have their support mounts 42 oriented identically, while middle pad 54 is rotated 180 degrees to offset its support mounts 42 from those directly above and below. Earrings 58 on pad 52 thus sit within the volumes between the downward projecting studs of earrings 60 on pad 54 while earrings 60 on pad 54 similarly nest between the studs of earrings 62.

As may be best seen in FIG. 3, steps 20 define a series of grooves 64 along the bottom surface of the framework. These grooves are so dimensioned as to be compatible with the top surfaces of walls 16 and therefore allow a series of frameworks 12 to be stacked one upon the other. When in such a stacked configuration the jewelry mounted upon a jewelry display pad element 14 lies within the chamber defined by walls 16 and the bottom surface of jewelry display pad element top 38 of the display framework stacked upon it. This provides for an efficient use of space and allows the maximum number of individual display apparatus frameworks to be stacked in the minimum amount of available volume. Further, since earring mounts 42 are displaced from the center line of the display pad element, the rotation of the individual pad elements by 180 degrees on successively stacked frames insures that there is no interference between adjacent layers.

As presented herein the display apparatus of the present invention provides an efficient method for the display and storage of jewelry elements. Individual removable display pads cooperate with the framework walls to provide a positive, but yet removable, attachment system. By the use of a thin display pad element the space below the element within the frame may be utilized as a storage area for another layer of jewelry, thus creating efficiencies in space utilization.

It is to be appreciated that numerous changes, modifications and adaptations of the invention as disclosed herein are possible and such adaptations, modifications and changes are intended to be embraced by the claims annexed hereto.

We claim:

1. A jewelry display and storage apparatus comprising a frame defining an open gridwork, said gridwork being formed of a series of vertically extending walls, each of said walls terminating at its lower edge in a horizontally projecting step; one or more jewelry mounting pads mounted within said gridwork, said jewelry mounting pads having a top surface upon which jewelry may be mounted and displayed, a bottom surface, and peripheral depending sides adapted to be embraced by said walls and supported by said projecting steps such that said gridwork and said bottom surface of said pads form an open-bottom chamber below said pads, said walls being so dimensioned and arranged to permit identical frame members to be stacked one atop the other, such that jewelry mounted on a mounting pad of a first display apparatus sits within an open-bottom chamber of the next stacked apparatus and is completely surrounded by and separated from adjacent jewelry items by walls of the next stacked apparatus.

2. Apparatus of claim 1 wherein said pad is selectively insertable and removable from said frame.

3. Apparatus of claim 2 wherein said walls are inwardly tapered to retain said pad.

4. Apparatus of claim 2 wherein said pad includes a first flocked layer and a second plastic layer.

5. Apparatus of claim 2 wherein said pad includes a dome shaped top and outwardly tapered sides.

6. Apparatus of claim 3 wherein said pad includes at least one jewelry mounting means.

7. Apparatus of claim 6 wherein said jewelry mounting means are assymetrically located on said pad to permit jewelry mounted thereon to be offset from that or the equivalent pad of the next stacked apparatus.

8. Apparatus of claim 7 wherein said jewelry mounting means includes a pair of hemispheric projections located upon the bottom of said top pad.

9. Apparatus of claim 6 wherein said jewelry mounting means includes a pair of slots on the periphery of said top adapted to receive a section of jewelry chain.

10. Apparatus of claim 9 further including a chain-receiving pocket located on the bottom, inner surface of said top.

* * * * *